United States Patent [19]

Garcia

[11] 4,140,410

[45] Feb. 20, 1979

[54] FLUID APPLICATOR PRESSURE DEVICE

[76] Inventor: Ricardo Garcia, 1045 W. 27th St., Apt. 5, Hialeah, Fla. 33010

[21] Appl. No.: 765,977

[22] Filed: Feb. 7, 1977

[51] Int. Cl.[2] ..... B43K 5/18; F04B 21/04

[52] U.S. Cl. ..... 401/150; 401/188 R; 401/208; 417/549

[58] Field of Search ..... 401/150, 143, 146, 187–189, 401/208; 417/549, 550, 555

[56] References Cited

U.S. PATENT DOCUMENTS 3,603,694 9/1971 Aamm ..... 401/150

3,809,484 5/1974 Bradshaw ..... 401/208

FOREIGN PATENT DOCUMENTS 480873 3/1938 United Kingdom ..... 401/150

860102 2/1961 United Kingdom ..... 401/150

732342 4/1966 United Kingdom ..... 401/150

*Primary Examiner*—Stephen C. Pellegrino

[57] ABSTRACT

This invention relates to a fluid pressure device and more particularly to a fluid pressure device adapted to be attached to a paint roller applicator for supplying paint from a container to the roller applicator.

8 Claims, 5 Drawing Figures

FLUID APPLICATOR PRESSURE DEVICE

BACKGROUND OF THE INVENTION

Paint rollers which have become very popular for applying paint on a surface have a main disadvantage in that they must be periodically supplied with paint which is usually done manually. Such a procedure, however, is cumbersome and time consuming. Heretofore, various pressure devices or pumps have been proposed for supplying paint to roller applicators but most of such devices have not been very successful for they are clumsy and ungainly.

SUMMARY OF THE INVENTION

The primary object of this invention is to provide a fluid pressure device which is of simple construction and operation, is very light in weight and which is adapted to be mounted on the handle of any paint roller applicator.

A further object of the invention is to provide a fluid pressure device for a paint roller applicator which requires no special reservoir of paint, is adapted to draw paint out of any paint container purchased in the market and which is easily cleaned after use.

In accordance with the present invention a fluid or paint applicator pressure device comprises a cylinder having a tubular piston and a tubular piston rod adapted to be connected to a conduit having a tubular shaft at the other end thereof for inserting into a paint container, valve means in said cylinder for controlling the fluid flow therein, and a nozzle connected to the cylinder by a flexible conduit and adapted to be mounted on the handle of a roller applicator for supplying paint to the roller applicator from the container.

The use of the applicator pressure device of the present invention will become more obvious from the reading of the following description of the preferred embodiment and from the accompanying drawing.

DETAILED DESCRIPTION OF PREFERRED EMBODIMENT

Figures 1, 2, 3, 4, 5:
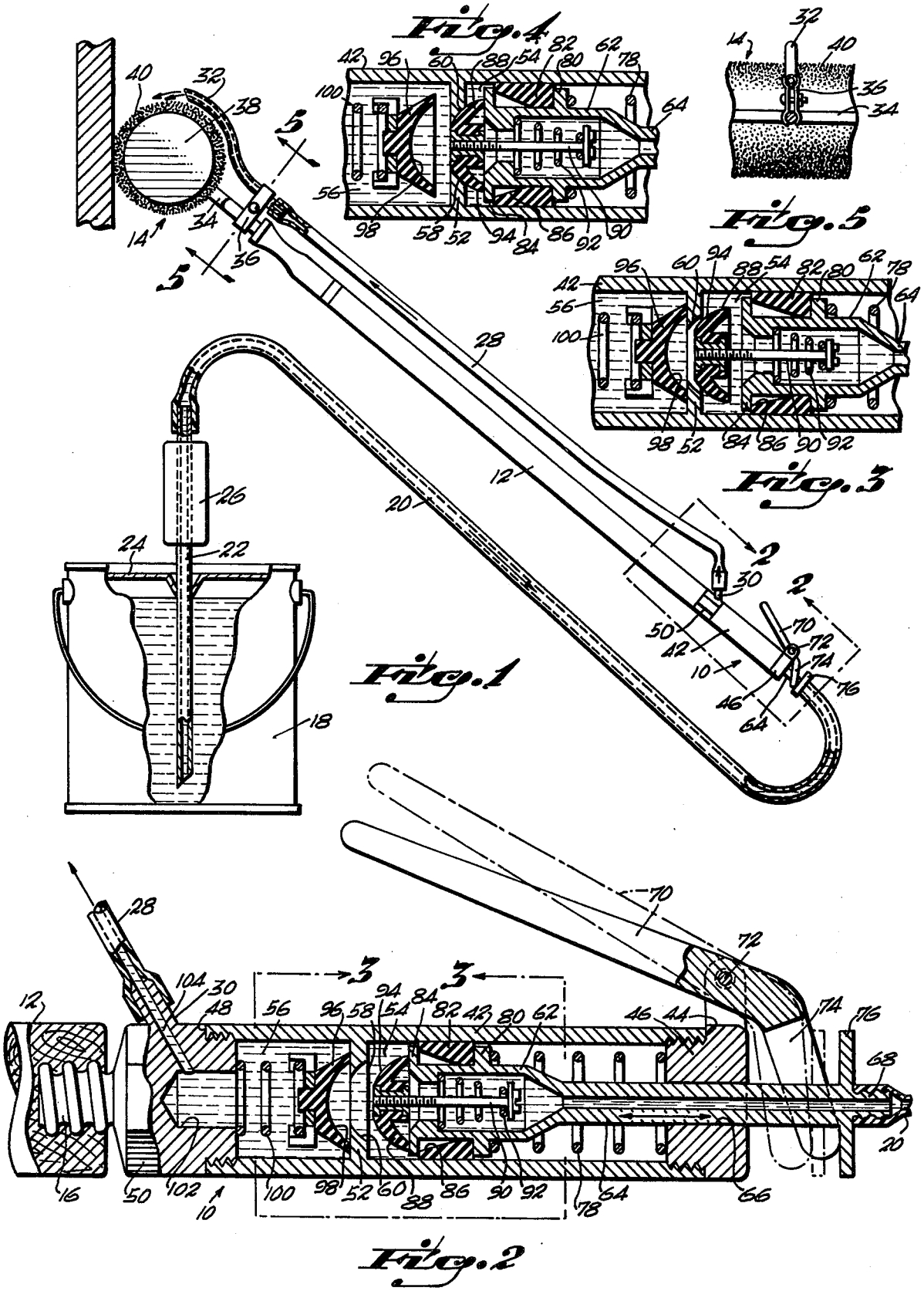
FIG. 1 is a side elevational view, partly in section showing the fluid applicator pressure device constructed in accordance with the present invention as used in connection with a paint roller applicator.
FIG. 2 is an enlarged sectional view of the fluid applicator pressure device of the invention showing the operating positions of the parts with the piston at its forward travel taken on the line 2—2 of FIG. 1.
FIG. 3 is a partially broken away sectional view showing the operating positions of the parts of the fluid pressure device with the piston at its rearward travel taken on the line 3—3 of FIG. 2.
FIG. 4 is a view similar to FIG. 3 but showing the operating positions of the parts of the fluid pressure device with the piston at its most forward position.
FIG. 5 is a broken away sectional view of the nozzle attachment taken on line 5—5 of FIG. 1.

Referring now to the drawing in detail, and particularly to FIG. 1, there is shown a fluid pressure device as used on a paint roller applicator, designated in general by numeral 10, attached to an elongated handle extension member 12 of a conventional paint roller applicator designated in general by numeral 14. The device 10 is adapted to be connected to the handle extension member 12 as by a stud 16 threadedly engaging the handle extension member 12. Fluid, such as paint, is drawn by the pressure device 10 from a paint source or container 18 through a feed tube or inlet conduit 20 of conventional flexible plastic material. The conduit 20 may be connected to a tubular shaft 22 adapted to be inserted through the closed top 24 of the container 18, thus eliminating the need for opening the container 18, first, and then inserting the inlet conduit 20 therein. A hand grip 26 on the tubular shaft 22 facilitates the handling of the shaft 22 in piercing the top or cover 24. An outlet conduit 28, also of conventional flexible plastic material connected to an outlet fitting 30 on the fluid pressure device 10 supplies paint under pressure to a nozzle 32 attached to a handle 34 of the paint roller 14, as by a conventional clamp 36, as shown in FIG. 5. The roller applicator 14 consists of a cylindrical core 38 mounted for rotation on the handle 34 and has an absorbent cover 40, as is well known in the art. The nozzle 32 preferably of metallic tubing is slightly curved so as to discharge the paint on the roller 14, where it is absorbed by the absorbent cover 40.

The fluid pressure device 10, illustrated in FIG. 2, comprises an elongated tubular member or cylinder 42 having a rear open end 44 closed by a screw plug member 46 tightly screwed thereon and a forward open end 48 also closed by a screw member 50 tightly screwed thereon. A circular inner cross wall 52 extending diametrically in the cylinder 42 adjacent to the forward end 48 forms a rear chamber 54 and a forward chamber 56, of which chambers the rear chamber 54 has a greater length axially than chamber 56. The circular inner cross wall 52 is provided with an axially extending conical opening or bore 58 at the center thereof formed with a conical or tapered wall 60 for passage of fluid from the rear chamber 54 to the forward chamber 56. The larger inlet port of the conical bore 58 being on the side of the rear chamber 54 and the smaller outlet port on the side of the forward chamber 56.

A tubular piston 62 and a tubular piston rod 64 integral therewith but of a reduced diameter extend axially in the rear chamber 54 for reciprocating movement of a short distance therein. The piston rod 64 extends through an axial bore 66 in plug 46 and outwardly rearwardly thereof and is adapted to be inserted at a rear free end 68 into the feed tube 20 for drawing fluid from the container 18. Air pressure in the cylinder chamber 54 rearwardly of the piston 62 is relieved through the clearance between the piston rod 64 and the wall of the bore 66 to the outside.

A squeezing handle 70 is mounted on a pivot 72 on the cylinder 42 for pivotal movement thereon. The handle 70 has a pair of fork-like legs 74 extending at an angle thereto and arranged to straddle the piston rod 64 for engaging a collar 76 on the piston rod 64 when the handle 70 is squeezed toward the cylinder 42, thus causing the piston rod 64 to move axially outwardly and rearwardly of the cylinder 42 for a short distance. When the handle 70 is released, the piston rod 64 returns to its normal forward position by the action of a helical spring 78 disposed on the piston rod 64 and abutting the inner wall of the rear plug 46 at one end and a collar 80 on the piston 62 at the other end. The piston 62 is sealed to the cylinder 42 by a cylindrical seal 82 disposed between the collar 80 and a forward collar 84 on the outer wall of the piston 62. The seal 82 is formed with an inner conical shaped wall 86 permitting slight yielding of the seal 82 during movement of the piston 62 and at the same time to act as a scraper for maintaining the inner wall surface of the cylinder 42 free of any paint thereon.

A first or rear valve 88 threadedly mounted on an adjusting screw 90 extending axially in the tubular piston 62 is biased to a closed position against the outlet port of the tubular piston 62 by a volute spring 92 disposed on the screw 90. The valve 88 is formed with a tapered or conical outer wall 94 adapted to seat on the tapered inner wall 60 of the conical bore 58 at the most forward position of the piston 62, as shown in FIG. 4. The valve 88 is adapted to travel in a direction opposite to that of the piston 62 when moving rearwardly in the cylinder 42 and in the same direction on the forward movement of the piston 62.

A second or forward valve 96 having an inner concave wall 98 is yieldingly mounted in the forward chamber 56 by a helical spring 100. The valve 96 is normally biased toward the circular wall 52 by the action of the spring 100 and by the suction of the concave inner wall 98 applied on the circular wall 52 thereby sealing the outlet port of the conical bore 58. The forward chamber 56 is in fluid communication with a closed end bore 102 in the forward plug 50 which is also provided with a fluid passageway 104 in fluid communication with the bore 102 and extending through the outlet fitting 30 over which is fitted the outlet tube 28.

In the operation of the pressure device 10, the forward suction valve 96 is in the closed position on the circular wall 52 and the rear valve 88 is also in the closed position on the tubular piston 62. Squeezing the handle 70 toward the cylinder 42 causes the piston rod 64 and the piston 62 to move rearwardly thus creating a vacuum or negative pressure in the chamber 54 forward of the piston 62. Movement of the piston 62 rearwardly causes the spring 92 to compress and the valve 88 to move forwardly of the piston 62 thus permitting passage of fluid from the outlet port of the piston 62 into the chamber 54 filling the space in front of the piston 62 and the space between the valve concave wall 98 and the circular wall 52, as shown in FIG. 3. At the end of the rearward movement of the piston rod 64, the valve 88 has returned to its closed position on the piston 62, and releasing the handle 70 causes the piston 62 with the valve 88 in the closed position to move forward by the action of the spring 78 until the rear valve 88 seats on the tapered inner wall 60 and closes the conical bore 58, as shown in FIG. 3.

The fluid in the space in front of the piston 62 being now under increasing pressure by the returning or forward movement of the piston 62 causes the valve 96 to move forward in the chamber 56 and to withdraw from the circular wall 52 by overcoming the action of the spring 100 and of its suction thereon and to open the outlet port of the bore 58 through which the fluid under pressure rushes into the chamber 56 and to the passageway 104 into the outlet tube 28 and to the nozzle 32 to be discharged on the paint roller 14, as shown in FIG. 1. When the pressure of the fluid in chamber 36 has dropped, the valve 96 returns to its closed position again by the action of the spring 100. While the forward valve 96 in in the open position, the rear valve 88 is in the closed position in the bore 58, as shown in FIG. 4. Repeated squeezing of the handle 70, of course, causes the piston 62 to reciprocate for a short distance and the valve 88 to open at the rearward travel of the piston 62 and then to close at the forward travel of the piston 62, while valve 98 is closed and then opens during this reciprocating movement of the piston 62, thus continuously drawing fluid into the chamber 54 and expelling the fluid under pressure from the chamber 54 into the chamber 56 and to the outlet tube 28.

The fluid pressure device or pump 10, even though illustrated as being used with a paint roller applicator, may also be used on a window cleaning device or on a floor waxing device, or with any other applicator of that type for supplying fluid thereto.

The preferred embodiment of the present invention has been described in the foregoing specification, however, it should be understood that the invention which is intended to be protected herein is not limited by that which is shown in the drawing and described in the specification, but only as defined in the appended claims.

What is claimed is:

1. A fluid applicator pressure device comprising a cylinder having a tubular piston and a tubular piston rod extending axially therein, seal means on said piston engaging the inner wall of said cylinder, a first valve means yieldingly mounted axially on said tubular piston for controlling the fluid flow through said piston, spring means biasing said valve means to a closed position, handle means pivotally mounted on said cylinder and engaging said piston rod for movement therewith, a circular cross wall extending diametrically in said cylinder and having an axially extending bore therein said first vale means biased to seat against one side of said circular cross wall bore, a second valve means yieldingly mounted in said cylinder for controlling the fluid flow from said circular wall bore, and spring means biasing said second valve means to a closed position against the other side of said circular cross wall bore.

2. A fluid applicator pressure device as defined in claim 1 a tubular shaft adapted to be inserted into a fluid container, and conduit means connecting said tubular shaft to said tubular piston rod for drawing fluid from the container.

3. A fluid applicator pressure device as defined in claim 2 nozzle means adapted to be mounted on a paint roller applicator, and conduit means connecting said nozzle means to said cylinder.

4. A fluid applicator pressure device as defined in claim 3 said cylinder having means for connecting to the handle of a paint roller applicator.

5. A fluid applicator pressure device as defined in claim 4 a paint roller applicator, and said cylinder and said nozzle means mounted on said paint roller applicator for supplying paint thereto.

6. A fluid applicator pressure device as defined in claim 1 said first valve means having a tapered outer wall, said circular cross wall having a tapered inner wall in said bore, and said first valve means tapered outer wall adapted to seat on said tapered inner wall in said circular cross wall bore for preventing fluid flow through said bore.

7. A fluid applicator pressure device as defined in claim 6 said second valve means having an inner concave wall for applying suction on said circular cross wall thereby sealing off said circular cross wall bore.

8. A fluid applicator pressure device comprising a cylinder having a bore of a reduced diameter at one end and a fluid outlet at the other end thereof, a diametrically extending circular wall in said cylinder having a center opening, said cylinder having a pair of axially extending chambers in fluid communication through said circular wall opening, a tubular piston having a tubular piston rod extending axially in one of said cylinder chambers and through said cylinder end opening protruding outwardly thereof and adapted to be connected to a fluid source at the protruding end thereof, said piston rod having a collar thereon, handle means pivotally mounted on said cylinder and engaging said piston rod collar for moving said piston rod rearwardly of said cylinder, spring means in said cylinder biasing said piston and piston rod forwardly in said cylinder, said piston having an outer seal engaging the inner wall of said cylinder, a first valve means yieldingly mounted axially on said tubular piston for movement in a direction opposite to that of said piston moving rearwardly in said cylinder and adapted to control the fluid flow through said tubular piston and through said circular wall opening, spring means in said tubular piston biasing said first valve means to a closed position, adjusting means on said first valve means for adjusting the spring tension thereon, a second valve means yieldingly mounted in the other of said chambers in said cylinder for controlling the fluid flow from said circular wall opening, spring means biasing said second valve to a closed position, and said second valve means adapted to open when fluid pressure overcomes said spring means during movement of said piston forwardly in said cylinder thereby permitting fluid to pass through said circular wall opening to the other of said chambers and to said cylinder outlet.

* * * * *